US005116417A

United States Patent [19]

Walker, Jr. et al.

[11] Patent Number: 5,116,417

[45] Date of Patent: May 26, 1992

[54] COMPOSITION AND METHOD FOR AGGLOMERATING ORE

[75] Inventors: Daniel D. Walker, Jr.; Joseph Oliphant, both of Henderson, Nev.

[73] Assignee: Chemical Lime Company, Fort Worth, Tex.

[21] Appl. No.: 528,350

[22] Filed: May 21, 1990

Related U.S. Application Data

[62] Division of Ser. No. 322,557, Mar. 13, 1989, abandoned.

[51] Int. Cl.[5] ..... C22B 1/08

[52] U.S. Cl. ..... 75/327; 106/710; 106/772; 106/775; 106/DIG. 1

[58] Field of Search ..... 75/746, 329, 770, 327, 75/773, 326, 313, 323, 322, 747; 23/313 R, 313 AS, 313 P; 252/184; 106/DIG. 1, 705, 710, 772, 775

[56] References Cited

U.S. PATENT DOCUMENTS

| | | | |
|---|---|---|---|
| 588,476 | 8/1897 | Rhodes | 75/3 |
| 1,574,252 | 2/1926 | Marczinczek | 106/710 |
| 2,915,378 | 12/1959 | Brennan | 75/5 |
| 3,288,569 | 11/1966 | Henrickson et al. | 423/17 |
| 3,565,648 | 2/1971 | Mori et al. | 106/710 |
| 3,777,004 | 12/1973 | Lankenan et al. | 423/20 |
| 3,785,840 | 1/1974 | Minnick et al. | 106/710 |
| 4,028,130 | 6/1977 | Webster et al. | 106/710 |
| 4,173,519 | 11/1979 | Parker et al. | 75/118 R |
| 4,256,706 | 3/1981 | Heinen et al. | 75/3 |
| 4,374,097 | 2/1983 | Holland | 423/27 |
| 4,701,309 | 10/1987 | Ramachandran et al. | 423/20 |

OTHER PUBLICATIONS

Grant & Hackh's Chemical Dictionary, 1987, pp. 105, 106, 107, 241, 272 and 455.

*Primary Examiner*—Michael Lewis
*Assistant Examiner*—Steven Bos
*Attorney, Agent, or Firm*—Charles D. Gunter, Jr.

[57] ABSTRACT

A binder composition is shown for agglomerating ore fines in a heap leaching ore recovery process. The binder composition comprises a calcareous component, a sulfate component and a siliceous-aluminous component such as fly ash. The ore fines are agglomerated by adding the binder composition thereto and a leach bed is formed of the agglomerated ore. The leach bed is leached with a leaching agent to form a leach liquor the metal values are recovered from the leach liquor.

4 Claims, No Drawings

COMPOSITION AND METHOD FOR AGGLOMERATING ORE

BACKGROUND OF THE INVENTION

1. Field of the Invention

The present invention relates to the recovery of metal values from ores and, specifically to a process and composition for agglomerating ore fines to enhance the economic recovery of metals in a heap leaching recovery process.

2. Description of the Prior Art

The recovery of precious metal values by cyanide solutions, and leaching by virtue of the standard heap leach process are known in the art. Such process are described, for example, in Landenan et al. U.S. Pat. No. 3,777,004, issued Dec. 4, 1973.

It is well recognized that the state of Nevada has extensive ore deposits of gold and silver. In these deposits, as well as in deposits in other states and localities, there has been found to occur an appreciable amount of fines, i.e., minus 40 mesh or finer, in the ore material. Such fines inhibit the degree of success that has previously been achieved in connection with recovery of precious metal values from such ores. A great deal of study has been conducted in connection with the character of such fines, resembling fine-particle clays of bentonitic type, and the effect of such fines in the presence of ores undergoing treatment for precious metal values.

In the prior art, heap leach piles and leaching solutions have been used with varying degrees of success. Many such processes have not been economically successful since the fine plasterings over rocks and interstices of heap leach piles have prevented the advantageous recovery of pregnant solutions or have allowed leaching fluids to percolate therethrough. In order to economically heap leach gold and silver ores, it has thus been found necessary to agglomerate the ores before leaching can begin, using some type of binder. The agglomeration prevents migration of ore fines, swelling of clays, and collapse of the heap. Migration of fines and swelling of clays can blind part of the heap making efficient leaching impossible. Collapse of the heap can seal-up large areas to the leaching solution and channel the solution around areas where it is needed. At the present time, high calcium lime and Portland cement are used as binders. Both of these binders have the advantage of maintaining the pH of the leaching solution in the range from about 10–12 which is necessary for leaching with a cyanide solution.

Lime, $Ca(OH)_2$, prevents the swelling of clay by replacing monovalent cations, $Na+$ and $K+$, with the divalent cation, $Ca++$. The presence of divalent cations prevents significant swelling of clays in the recovery process. Also, lime reacts with silica and alumina in the clays and ore fines giving calcium silicate and aluminates, hydrates binding the agglomerates together, thus preventing migration of fines and heap collapse.

In Portland cement, calcium silicates and aluminates are already intimately mixed so that the hydrates form rapidly, giving good strength to the agglomerate. If the ore is of low clay content or the clay has a low pozzolinic activity, i.e., the low availability of silicates and aluminates, I have found that Portland cement will make a higher strength binder than lime. Portland cement has low free calcium hydroxide content, however, and accordingly is not as efficient as lime in preventing swelling of clays in high clay content ores.

The present invention has as its object the provision of an economical recovery technique for precious metal values from metal ores through the use of an improved binder composition for agglomerating the ore fines. The technique has particular applicability to the recovery of gold and silver

SUMMARY OF THE INVENTION

The binder composition for agglomerating ore fines of the invention is a mixture of (1) a reactive calcareous component, (2) a reactive siliceous and aluminous component, and (3) a sulfate compound. Preferably, the binder composition is comprised of 10 to 80% by weight lime as the calcareous component, 5 to 50% by weight fly ash as the siliceous-aluminous component and 10 to 80% by weight sulfate compound such as gypsum. Most preferably, the siliceous-aluminous component is a low carbon content fly ash having less than about 0.5% by weight carbon content. The preferred lime component of the binder composition is either a high calcium lime with greater than about 90% by weight CaO content or a dolomitic lime.

In the process for recovery of metals from ores having ore fines of the metals, the ore fines are first agglomerated by adding thereto a binder composition, the binder composition comprising about 10 to 80% by weight lime, 10 to 80% by weight sulfate compound and 5 to 50% by weight silicious-aluminous material. A leach bed is formed of the agglomerated ore and the bed is leached with a leaching agent to thereby form a leach liquor. The metal values are recovered from the leach liquor.

Additional objects, features, and advantages will be apparent in the written description which follows.

DETAILED DESCRIPTION OF THE INVENTION

The preferred binder composition of the invention comprises a mixture of (1) a reactive calcareous component such as lime (high calcium or dolomitic), (2) a reactive siliceous-aluminous component, and (3) sulfur or sulfate compound such as gypsum. The three component mixture of the invention produces a binder composition for ore fine agglomeration with superior properties to both lime and Portland cement.

The reactive calcareous component of the binder composition is an inorganic substance containing calcium and/or magnesium oxide or hydroxide or other form of chemically combined calcium or magnesium which, under the conditions employed in the steps of the process, reacts with the siliceous, aluminous and sulfur components of the composition to form calcium, aluminous, sulfur, silica hydrates (e.g. ettringite and tobermorite). The preferred reactive calcareous substance is high calcium quick lime. The high calcium quick lime, CaO useful in the present invention has a CaO content of greater than about 90% by weight, preferably greater than about 95% by weight. The reactive calcareous component is preferably present in the range from about 10 to 80% by weight of the binder composition.

The binder composition also contains a reactive siliceous-aluminous component which is employed in making the calcium silicate, calcium aluminate hydrate product of the invention. Such reactive siliceous-aluminous components include artificial or natural pozzolans, pulverized fuel ash (fly ash), granulated slag, pumice dust, ground silica, clays such as bentonite or kaolinite, Portland cement kiln dust and others, as well as mixtures thereof having a pozzolanic character. By "pozzolan" is meant a finely divided material rich in silica or alumina which, while not necessarily cementitious in itself, will react at ordinary temperatures with hydrated lime in the presence of water to form cementitious products.

The preferred siliceous/aluminous component is a fly ash having a low carbon content. Fly ash is a commercially available product which will be familiar to those skilled in the art. In the 1920s, a more effective method of firing power plant boilers came into use consisting of the pulverizing of the coal into a fine powder, the addition of a primary air, and the burning of the coal powder substantially in a suspended state within the furnace. Such coal is pulverized, conveyed from the pulverizer with air into the furnace, and combustion takes place almost instantly while the fine coal particles are in a suspended state. This method of burning coal has come into wide use due to its increased efficiency of combustion. The ash content of the coal, which may vary from a low of about 4% to a high of about 20% or more, is subject to the intense heat of combustion which may run between 2,000 and 2,800° F. Most of the ash is in the form of fly ash: the discreet sphere-like particles which are convected upwardly with the flu gases and separated therefrom by electrostatic or mechanical collectors A typical fly ash composition contains the following constituents: $Al_2O_3$, 15–35%; $SiO_2$, 40–44%; $Fe_2O_3$, 5–25%; $SO_3$, 0–5%; $FeS_2$, 0–1%; MgO, 1–3%; CaO, 1–5%; $TiO_2$, 1–3%; C, 0–5%.

The preferred fly ash component useful in the present invention has less than about 0.5% by weight carbon by direct carbon analysis. The fly ash component is present in the range from about 5 to 50% by weight of the binder composition.

The preferred sulfate compound of the binder composition is gypsum, a readily available mineral that needs only to be ground for use in the binder composition. Preferably, the gypsum ($CaSO_4 \cdot 2H_2H$) is ground in the range from about 100%-10 mesh to about 100%-200 mesh before making the binder composition. Other sources of sulfates such as waste wall board or fossile fuel power plant line scrubber sludge can also be utilized.

The binder composition is itself used in the range from about 0.100 to 2.000% by weight of ore to be treated, preferably in the range from about 0.500 to 1.500% by weight of ore.

The mixture of high calcium lime, gypsum and low carbon content fly ash gives a binder composition for ore fines agglomeration with superior properties to both lime and Portland cement. Theoretically, this result can be explained as follows: When hydrated, a reaction occurs between the lime, sulfate, and alumina in the fly ash to form ettringite, a calcium alumina sulfate hydrate. Microscopically, ettringite forms an interlocking set of rod-shaped crystals binding the ore fines together. The result is ore agglomerates with good strength properties even in low clay content ores. Calcium from both the lime component and the gypsum component of the binder composition can replace monovalent cations in swelling clays and prevent swelling. As a result, the binder composition of the invention is particularly well suited for use in high clay content ores.

An ore is agglomerated by mixing the granulated ore with the dry binder composition. Water is then mixed with the binder composition-ore mixture to agglomerate the ore. The agglomerate can be air dried or cured in an oven. If air cured in place, 3 to 28 days, or preferably 7 to 10 days, is required to develop the desired strength. A leach bed is then formed of the agglomerated ore fines and the bed is leached with a leaching agent to form a leach liquor. The metal values are recovered from the leach liquor in accordance with standard procedure.

The following example is intended to be illustrative of the invention.

Example I

To test the strength of ore agglomerates made with different binders, the −40 mesh fraction of an ore was separated out and portions were mixed with 5% by weight of the binders to be tested. Enough water was added to each mixture to form a thick paste and the paste placed in cube molds. The mixtures were cured in the molds for twenty-four hours at 120° F. (to simulate 30 days curing at room temperature) in a 100% relative humidity atmosphere. The cubes were then tested to failure to measure unconfined compressive strength The binders tested and the strengths obtained are given in Table I.

TABLE I

| Binder Composition | Unconfined Compressive Strength After Curing 24 hours at 120° F. |
|---|---|
| Type II Portland Cement | 93.0 p.s.i. |
| 40% Hi-Cal QL, 22.5% Fly Ash, 37.5% Gypsum | 97.0 p.s.i. |
| 40% Hi-Cal QL, 22.5% Clay, 37.5% Gypsum | 95.0 p.s.i. |
| 40% Hi-Cal QL, 22.5% Fly Ash, 37.5% Ground Gypsum Wallboard | 92.5 p.s.i. |
| 40% Dolomitic QL, 22.5% Fly Ash, 37.5% Gypsum | 52.5 p.s.i. |

EXAMPLE II 50 pounds of a minus ½ inch fraction of a gold ore was treated with 0.53 pounds of a binder composition made up of 40% lime, 22.5% fly ash and 37.5% gypsum, all percents being in parts by weight. The gypsum had been ground to pass a minus 30 mesh sieve before making the binder composition. Treatment and agglomeration were carried out by placing the air dry ore in the 55 gallon drum of a drum roller. The dry binder composition was sprinkled on top of the ore and the binder composition —ore mixture was rotated in the drum at 10 RPM for 1 minute.

Approximately 1,820 milliliters of water was then slowly added while rotating the drum for 4 minutes. The addition of the wetting agent caused the fine particles of ore to stick together or stick to the coarser particles to form an agglomerated ore. Total weight of the agglomerated ore was 54.5 pounds.

Then, 51.5 pounds of the agglomerated ore mixture was placed in a Plexiglass column of 5.25 inch internal diameter, forming a column of ore 62 inches tall with a wet density of 66.3 pounds per cubic foot. Another 50 pound aliquot of the ore was agglomerated with 1,770 milliliters of water in an identical manner without the binder composition. 51.5 pounds of this ore formed a column 57.75 inches tall, with a wet density of 71.2 pounds per cubic foot. The agglomerates were allowed to cure for 7 days.

Both columns were leached at 200 milliliters per hour (0.006 gallons per minute per square foot) with a solution of water containing 0.05% sodium cyanide and 0.09% sodium hydroxide. The sodium hydroxide was added to bring the initial pH of the water into a range between about 11 and 12. During the first 4 hours of leaching, the column containing the ore treated with the binder composition of the invention settled by 1.5 inches (2.4%) giving an ore column height of 60.5 inches and an ore density of 67.9 pounds per cubic foot. During the same 4 hours, the untreated ore settled by 7.75 inches (13.4%) to a column height of 50 inches with an ore density of 82.2 pounds per cubic foot. After 4 hours of leaching, no further settlement of the ore was detected.

A third column was also prepared in an identical manner using 0.50 pounds of Type 2 Portland cement and 1,760 milliliters of water for agglomeration. The initial column height was 62.5 inches giving an ore density of 65.8 pounds per cubic foot. No settling of this column was detected during the leaching.

It was noted that the leaching solution started to filter out the bottom of the Portland cement treated column in about 30 minutes while it took 4–5 hours for solution to begin filtering out the bottom of the binder treated and untreated columns. This indicates a solution retention or holding capacity of about 100 millimeters in the Portland cement treated column and 800–1,000 milliliters in the other two columns.

Leaching solution was collected and tested for pH, gold content, and cyanide content several times during the leaching period. The values are given in Table II:

TABLE II

| Leaching Time (hrs.) | Leaching Solution Data From Columns: pH | NaCN Concentration (%) | Cumulative Gold Leached (mg) |
|---|---|---|---|
| | Column 1 (No Treatment) | | |
| 20 | 8.0 | 0.005 | 15.4 |
| 27 | 8.4 | 0.010 | 18.8 |
| 45 | 9.3 | 0.040 | 22.0 |
| 69 | Stopped Leaching Because of Low pH. | | |
| | Column 2 (Portland Cement Treatment) | | |
| 20 | 11.5 | 0.02 | 7.1 |
| 27 | 11.5 | 0.02 | 9.3 |
| 45 | 11.5 | 0.04 | 13.2 |
| 69 | 11.5 | 0.04 | 17.6 |
| | Column 3 (Binder Composition) | | |
| 20 | 11.5 | 0.01 | 16.6 |
| 27 | 11.5 | 0.03 | 19.4 |
| 45 | 11.5 | 0.04 | 22.9 |

TABLE II-continued

| Leaching Time (hrs.) | Leaching Solution Data From Columns: pH | NaCN Concentration (%) | Cumulative Gold Leached (mg) |
|---|---|---|---|
| 69 | 11.5 | 0.04 | 26.5 |
| | Column 4 (Lime Treatment) | | |
| 20 | 11.5 | 0.01 | 14.2 |
| 27 | 11.5 | 0.03 | 17.1 |
| 45 | 11.5 | 0.04 | 20.8 |
| 69 | 11.5 | 0.04 | 23.3 |

It can be seen from Table II that both the Portland cement and binder composition treatments keep the pH high enough to prevent excessive cyanide losses. It is believed that the low gold recoveries found for the Portland cement treatment are due to the low amounts of solution held on the ore, i.e., the Portland cement does not allow the ore to wet as well as the ore treated with the binder composition, slowing down or preventing high gold recoveries.

An invention has been provided with several advantages. The improved binder composition of the invention produces an agglomerated ore with superior properties. In addition, the binder composition of the invention is more economical to manufacture than either Portland cement or lime alone.

While the invention has been shown in only one of its forms, it is not thus limited but is susceptible to various changes and modifications without departing from the spirit thereof.

I claim:

1. A heap leach bed which is leached with an aqueous cyanide leaching agent for recovering gold and silver metals, comprising:

granulated ore containing precious metal values selected from the group consisting of gold and silver metals;

a binder composition in an amount of 0.001 to 2.000% by weight of ore mixed with the granulated ore, the binder composition comprising:

10 to 80% by weight lime;

10 to 80% by weight gypsum;

5 to 50% by weight fly ash; and water added to the mixture of granulated ore and binder composition in an amount effective to form an agglomerated ore; and wherein said fly ash is low carbon fly ash having less then 0.5% by weight carbon.

2. The heap leach bed of claim 1, wherein the lime is a high calcium quicklime having greater than about 90% CaO content by weight.

3. The heap leach bed of claim 1, wherein said lime is a dolomitic lime.

4. The heap leach bed of claim 1, wherein said gypsum is calcium sulfate dihydrate.

* * * * *